United States Patent [19]

Wild

[11] Patent Number: 4,932,191

[45] Date of Patent: Jun. 12, 1990

[54] APPARATUS AND METHOD FOR PACKING VIALS INTO A CASE POSITIONED THEREBELOW

[76] Inventor: Anton J. Wild, 182 Blvd., Kenilworth, N.J. 07033

[21] Appl. No.: 374,886

[22] Filed: Jul. 3, 1989

[51] Int. Cl.[5] ..... B65B 5/10; B65B 35/30; B65B 39/06

[52] U.S. Cl. ..... 53/448; 53/247; 53/473; 53/534; 53/543

[58] Field of Search ..... 53/244, 246, 247, 249, 53/250, 251, 443, 448, 473, 475, 534, 543; 198/418.1, 418.5, 431

[56] References Cited

U.S. PATENT DOCUMENTS

| | | | |
|---|---|---|---|
| 2,036,421 | 4/1936 | Luckie . | |
| 2,308,209 | 1/1943 | Schmutzer et al. . | |
| 2,730,279 | 1/1956 | Enock . | |
| 2,898,716 | 8/1959 | Eella et al. | 53/250 X |
| 2,921,425 | 1/1960 | Seval | 53/247 |
| 2,978,854 | 4/1961 | Fairest | 53/534 X |
| 2,999,343 | 9/1961 | Berry . | |
| 3,397,504 | 8/1968 | Drennan . | |
| 3,553,927 | 1/1971 | Anglade | 53/448 |
| 3,592,002 | 7/1971 | Alduk | 53/247 X |
| 3,653,178 | 4/1972 | Bauer | 53/248 X |
| 3,914,921 | 10/1975 | Doran et al. | 53/247 X |
| 4,003,185 | 1/1977 | Goff | 53/248 X |
| 4,048,783 | 9/1977 | Raudat . | |
| 4,191,003 | 4/1980 | Talarico | 53/247 X |
| 4,259,826 | 4/1981 | Campbell | 53/543 |
| 4,300,330 | 11/1981 | Hartness | 53/539 |
| 4,332,123 | 6/1982 | Calvert | 53/475 |
| 4,531,345 | 7/1985 | Nigrelli | 53/534 |
| 4,754,598 | 7/1988 | Wild | 53/247 X |

*Primary Examiner*—Robert L. Spruill
*Assistant Examiner*—Linda B. Johnson
*Attorney, Agent, or Firm*—Sperry, Zoda & Kane

[57] ABSTRACT

An apparatus and method for packing vials into a case wherein vials are supplied through an infeed system and are organized into longitudinally extending rows defined between guide members. The guide rows or guide channels are adapted to grasp the vial below the neck for suspending it therebelow. The guide shoulders extending below the necks of the vials are not movable with respect to the guide members themselves. The guide assembly includes an inlet end through which vials enter for ordering into rows and the vial output end through which vials are removed upon placement into a case therebelow. The guide assembly is movable between an upper position and a lower position. In the lower position the vials extend to an intermediate position within the case such that removal of the case by the case pusher device will remove the vials from the guide channels and allow them to gently drop into the case as it is removed.

24 Claims, 5 Drawing Sheets

APPARATUS AND METHOD FOR PACKING VIALS INTO A CASE POSITIONED THEREBELOW

BACKGROUND OF THE INVENTION

1. Field Of The Invention

The field of the invention deals with the field of devices for packing of a plurality of vials supplied by an infeed system into one or more cases of any configuration.

The present invention is particularly adaptable for the packing of very small and normally lightweight vials such as those used for providing small quantities of medicine in pill or liquid form. These vials are often plastic and very lightweight and as such are very difficult to handle. The present invention is specifically useful for such pharmaceutical applications and can be utilized as a single station or as multiple horizontally oriented stations including two or three specific vial packing guide assemblies moved simultaneously between an upper vial receiving position and a lower vial placement position.

2. Description Of The Prior Art

There are many examples in the prior art of vial packing apparatus such as U.S. Pat. No. 2,036,421 patented Apr. 7, 1936 to E. B. Luckie on a Method And Apparatus For Inserting Bottles In Boxes; U.S. Pat. No. 2,308,209 patented Jan. 12, 1943 to C. Schmutzer et al on an Article Transferring Apparatus; U.S. Pat. No. 2,730,279 patented Jan. 10, 1956 to A. Enock on Bottle Crating And Decrating Machines; U.S. Pat. No. 2,999,343 patented Sept. 12, 1961 to R. Berry on Machines For The Packing Of Bottles Or Like Articles Into Cases Or The Like; U.S. Pat. No. 3,397,504 patented Aug. 20, 1968 to J. Drennan on a Method Of Handling Beverage Bottles; U.S. Pat. No. 3,592,002 patented July 13, 1971 to F. Alduk on a Drop-Through Case Packer; U.S. Pat. No. 3,653,178 patented Apr. 4, 1972 to E. Bauer on an Apparatus For Charging Trays Having A Surrounding Flange With Articles Ordered In Groups; U.S. Pat. No. 3,914,921 patented Oct. 28, 1975 to R. Doran et al on a High Speed Carton Casing Apparatus; U.S. Pat. No. 4,003,185 patented Jan. 18, 1977 to O. Goff on a Caser Apparatus; U.S. Patent No. 4,048,783 patented Sept. 20, 1977 to J. Raudat et al on a Case Loader With Invert Grid And Pushdown Feature; U.S. Pat. No. 4,300,330 patented Nov. 17, 1981 to T. Hartness on a Bottle Loading Machine; U.S. Pat. No. 4,531,345 patented July 30, 1985 to N. Nigrelli et al on a Case Loader; and U.S. Pat. No. 4,754,598 patented July 5, 1988 to A. Wild on a Bottle Packing Apparatus.

SUMMARY OF THE INVENTION

The present invention provides an apparatus and method for packing vials into a case positioned therein which includes a housing means adapted to receive the case positioned therein. A carriage is movably mounted with respect to the housing above the case. The carriage is movable between an upper position spatially disposed above the case and a lower position somewhat closer to the case therebelow.

A guide assembly is secured with respect to the carriage and includes a plurality of guide members spatially disposed with respect to one another to define guide channels therebetween which are adapted to receive and removably retain vials therein for arranging into rows. Each of the guide channels defines an input end which is adapted to receive vials for packing and an output end adapted for exiting of vials simultaneously with packing. A guide shoulder is included located on the guide means preferably on the lowermost area thereof which extends generally horizontally therefrom to be adapted to abut the vial to facilitate selective retaining thereof within the guide channels. Preferably the guide shoulder sections are designed to contact the vial immediately below the neck area for suspending the vial from the guide channels defined therebetween.

A vial infeed device is positioned adjacent to the input end of the guide channels and is adapted to provide vials to the guide channels by urging same through the input end thereof.

A drive member is operatively secured with respect to the carriage for urging movement thereof between an upper position and a lower position. The carriage is responsive to being in the upper position to facilitate the guide assembly to receive vials through the input ends of the guide channels from the vial infeed device. Furthermore the carriage is responsive to being in the lower position to locate the vials at an intermediate position which partially extends downwardly into the case therebelow to facilitate removal of vials positioned within the guide channels responsive to removal of the case from the housing.

Preferably the guide members of the assembly will define five longitudinally extending guide channels. Also preferably the carriage means is movable in a vertical direction between the upper and lower position. This vertical movability is made possible by vertical rods being located within the housing which are adapted to be engaged by vertical couplings fixedly secured to the carriage. In this manner the guiding of vertical movement of the carriage with respect to the housing will be facilitated.

The vial infeed means preferably includes a dead plate positioned below the vials to facilitate support thereof. Preferably the vial infeed means is in a slightly inclined direction to facilitate feeding of the vials preferably by line pressure thereof to the input end of the guide channels.

With the carriage in the upper position the vials will be suspended by the shoulder means contacting in the neck area thereof. Movement of the carriage to the lower position will cause the array of vials suspended from the guide assembly to extend part way into the case therebelow. A case pusher means may be included adapted to operatively abut the case to facilitate horizontal removal therefrom. Since the vials are partially extending into the case removal of the case will urge the vials to be removed through the output end of the guide channels wherein the vials will gently drop completely into the case as the case is removed from the housing by actuation of the case pusher means.

It is an object of the present invention to provide an apparatus and method for packing vials into a case positioned therebelow wherein packing of lightweight vials is facilitated.

It is an object of the present invention to provide an apparatus and method for packing vials into a case positioned therebelow wherein packing of plastic vials is facilitated.

It is an object of the present invention to provide an apparatus and method for packing vials into a case positioned therebelow wherein packing of vials utilizing the pharmaceutical industry is facilitated.

It is an object of the present invention to provide an apparatus and method for packing vials into a case positioned therebelow wherein initial capital cost of equipment is minimized.

It is an object of the present invention to provide an apparatus and method for packing vials into a case positioned therebelow wherein maintenance costs are minimized.

It is an object of the present invention to provide an apparatus and method for packing vials into a case positioned therebelow wherein machinery down time is minimized.

It is an object of the present invention to provide an apparatus and method for packing vials into a case positioned therebelow wherein the number of moving parts within the system is minimized by fixedly positioning the vial suspension shoulders with respect to the guide plates located between adjacent guide channels.

It is an object of the present invention to provide an apparatus and method for packing vials into a case positioned therebelow wherein several identical stations can be positioned laterally to facilitate as many as three or more individual vial guide assemblies being simultaneously operated by being simultaneously connected with respect to a single carriage assembly.

It is an object of the present invention to provide an apparatus and method for packing vials into a case positioned therebelow wherein high speed operation is easily achievable.

It is an object of the present invention to provide an apparatus and method for packing vials into a case positioned therebelow wherein damaging to product is minimized.

It is an object of the present invention to provide an apparatus and method for packing vials into a case positioned therebelow wherein damaging to cases even those cases made of paper or paperboard materials is minimized.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
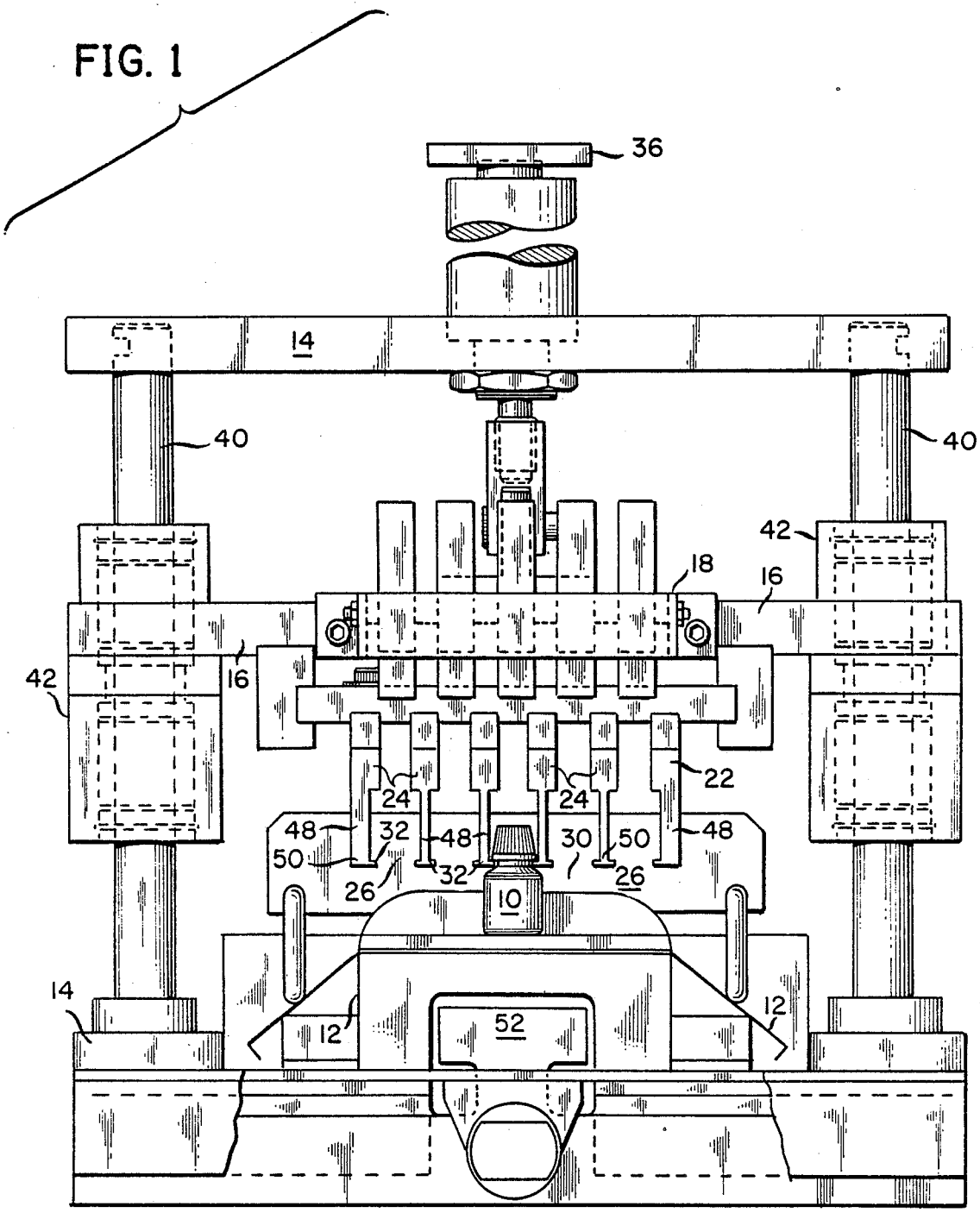
FIG. 1 is a front plan view of an embodiment of the apparatus for packing vials into a case of the present invention showing the carriage in the upper vial receiving position.
Figure 2:
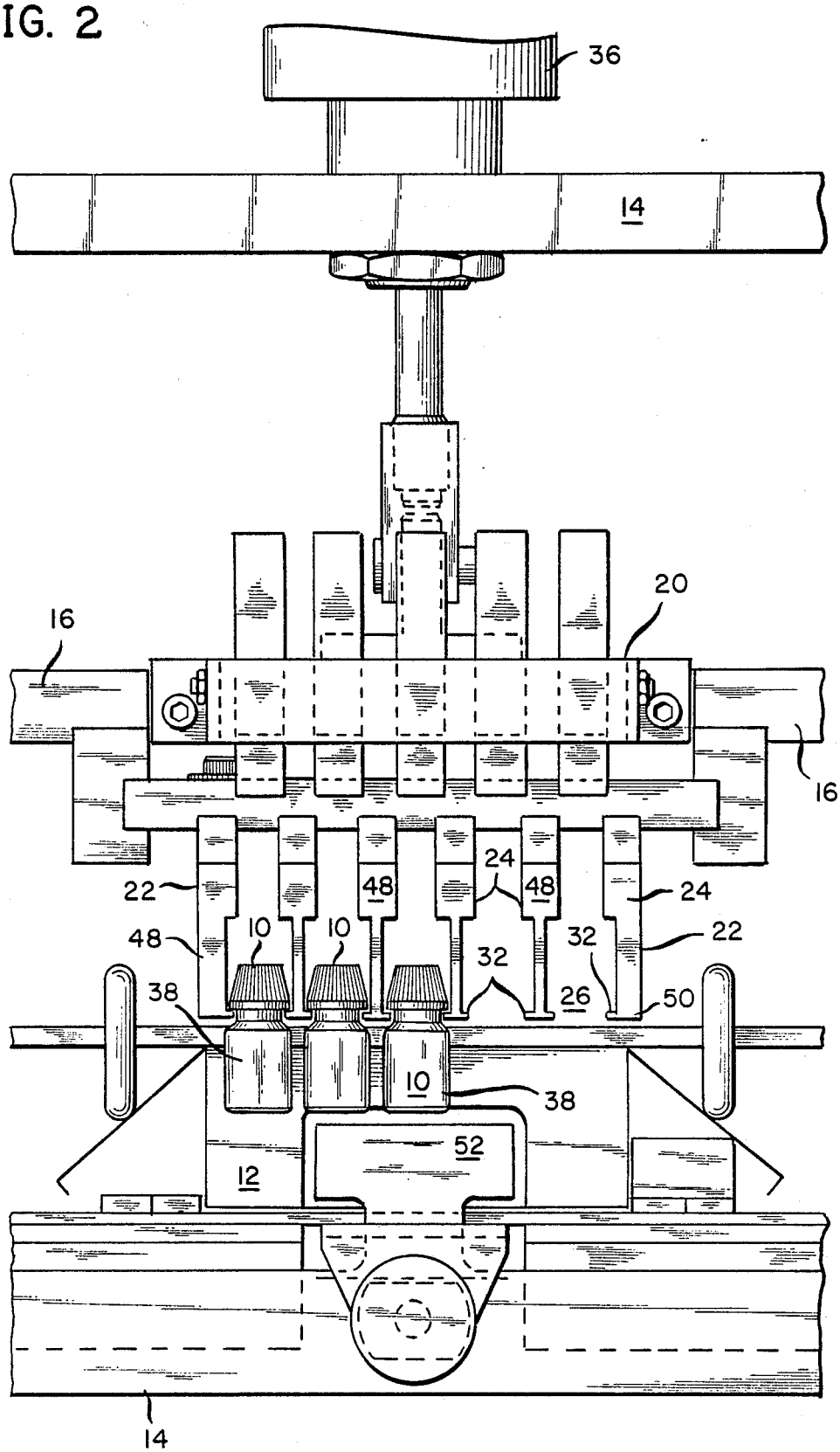
FIG. 2 is a view of the embodiment shown in FIG. 1 with the carriage assembly shown in the lower vial placement position showing the vials in the intermediate position partially extending into the cases.

The present invention provides an apparatus and method for packing vials 10 within one or more cases 12 positioned within the housing 14 thereof. A carriage means 16 is positioned therein such as to be movable between an upper position 18 and a lower position 20.

In the upper position 18 carriage means 16 is adapted to receive vials 10 therein for organizing thereof into a plurality of longitudinally extending rows. In the lower position 20 the carriage means 16 urges the vials 10 to move downwardly to an intermediate vial position 38, partially extending into case 12 therebelow to facilitate packing thereof.

Orienting of the vials 10 into a plurality of longitudinally extending rows is made possible by a guide assembly 22 which may include a plurality of vertically extending guide members 24 oriented generally parallel with respect to one another such as to define a plurality of guide channels 26 therebetween. The guide channels 26 are preferably parallel with respect to one another and extend longitudinally with respect to the direction of supplying of vials 10 by the vial infeed means 34 located upstream therefrom.

Each guide channel 26 includes an input end 28 adapted to receive vials 10 therethrough for placement therein. Furthermore, guide channels 26 include an output end 30 defined at the downstream end thereof which is adapted to allow vials 10 to exist therefrom for movement into the case 12 positioned therebelow.

Guide shoulder means 32 are defined preferably at the lowermost ends 50 of guide members 24 shown in FIG. 1 as guide plates 48. The guide shoulder means 32 are adapted to abut the vials 10 in the neck area thereof to facilitate suspending of vials 10 from the guide channels 26.

A drive means 36 is included operatively secured with respect to the carriage means 16 to urge movement thereof between the upper position 18 and the lower position 20 selectively. Movement of the carriage means 16 is facilitated by vertical rods 40 included within housing 14. These vertical rods are preferably oriented in an approximately vertically extending direction and are useful for guiding movement of the carriage means 16 with respect to the housing 14. Vertical coupling means 42 is preferably fixedly secured with respect to the carriage means 16 and is adapted to engage the vertical rods 40 for movement vertically therealong. Engagement between the vertical coupling means 42 and the vertical rods 40 causes orientation of vertical movement of the carriage means 16 with respect to the housing means 14.

Figure 3:
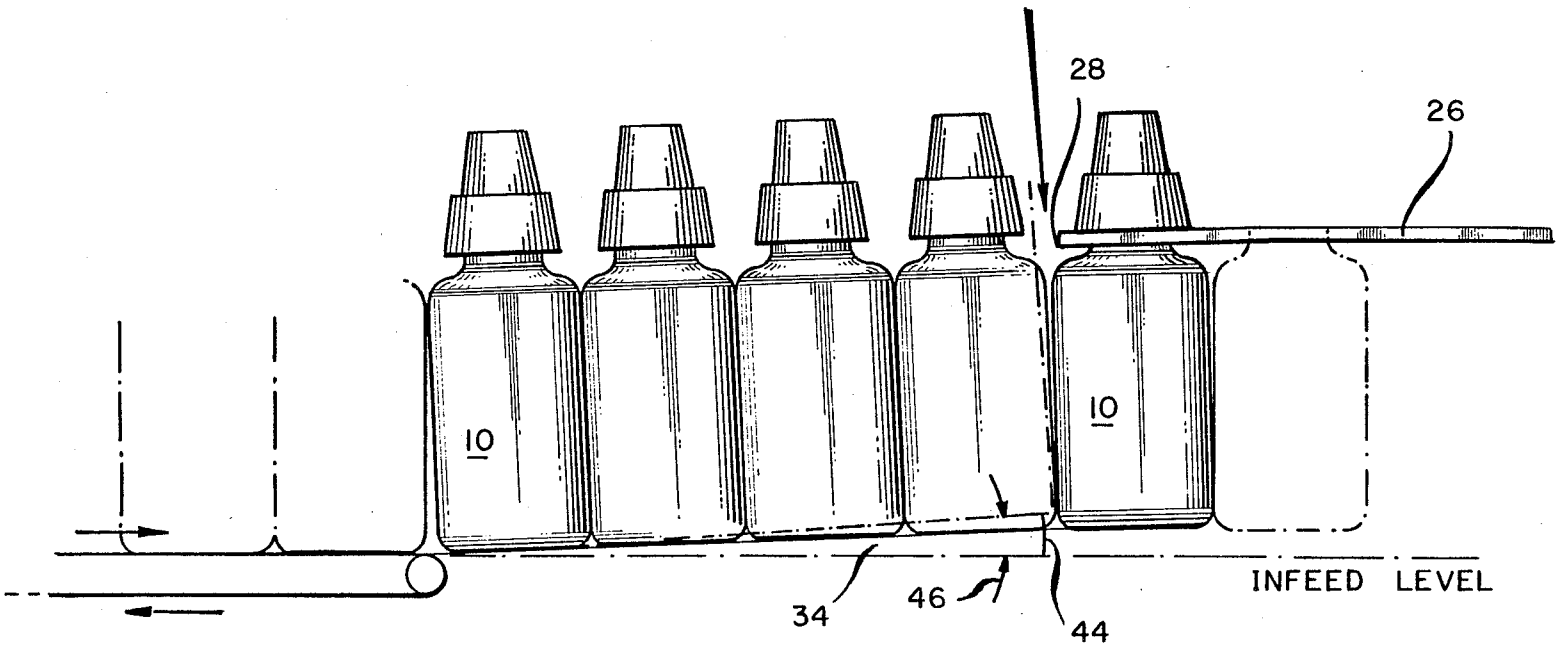
FIG. 3 is aside plan view of an embodiment of the vial infeed device of the present invention.
Figure 4:
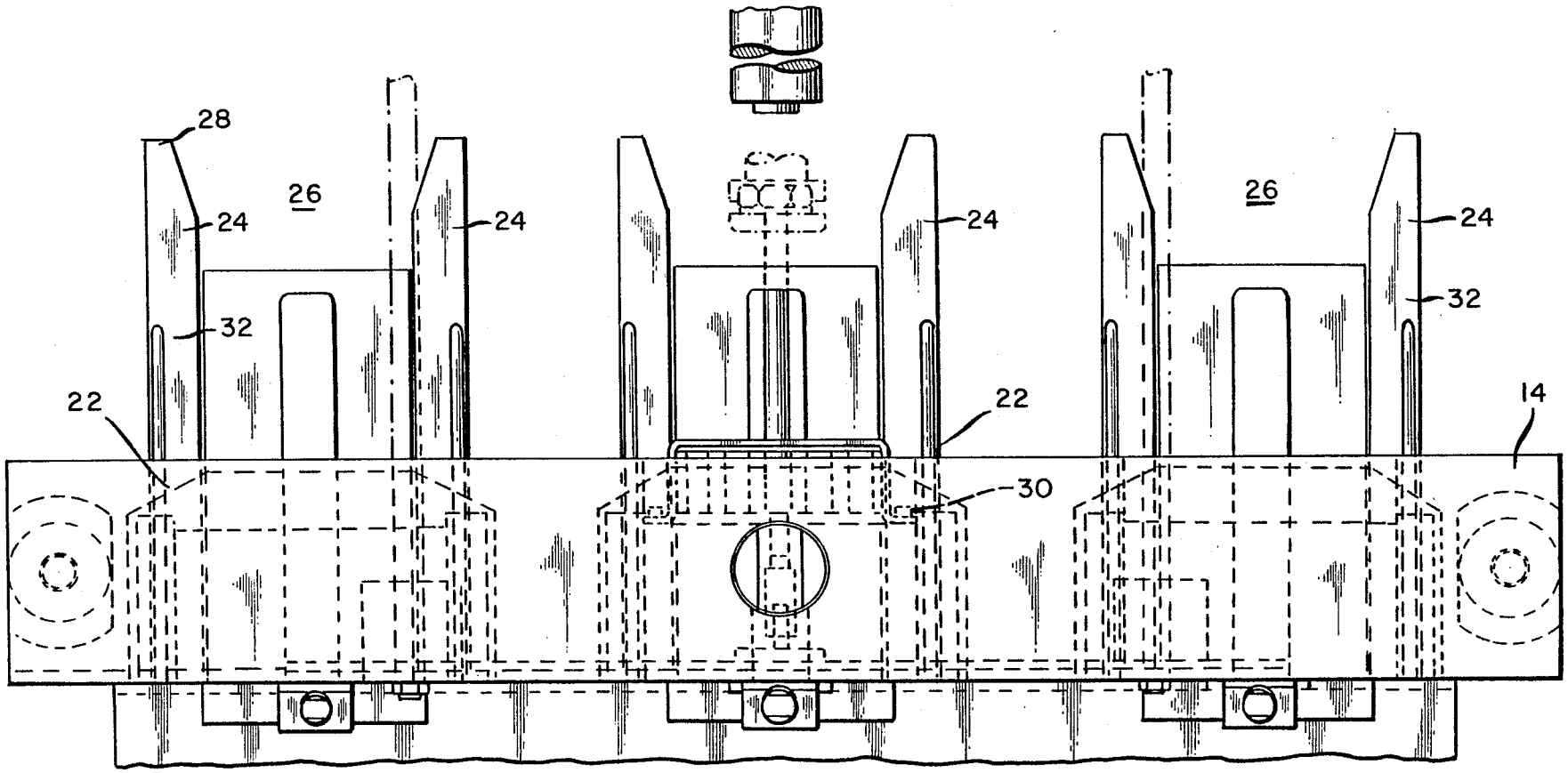
FIG. 4 is a top plan view of the embodiment shown in FIG. 1 showing three vial guide assemblies positioned laterally adjacent one another to facilitate simultaneously packing of three cartons.
Figure 5:
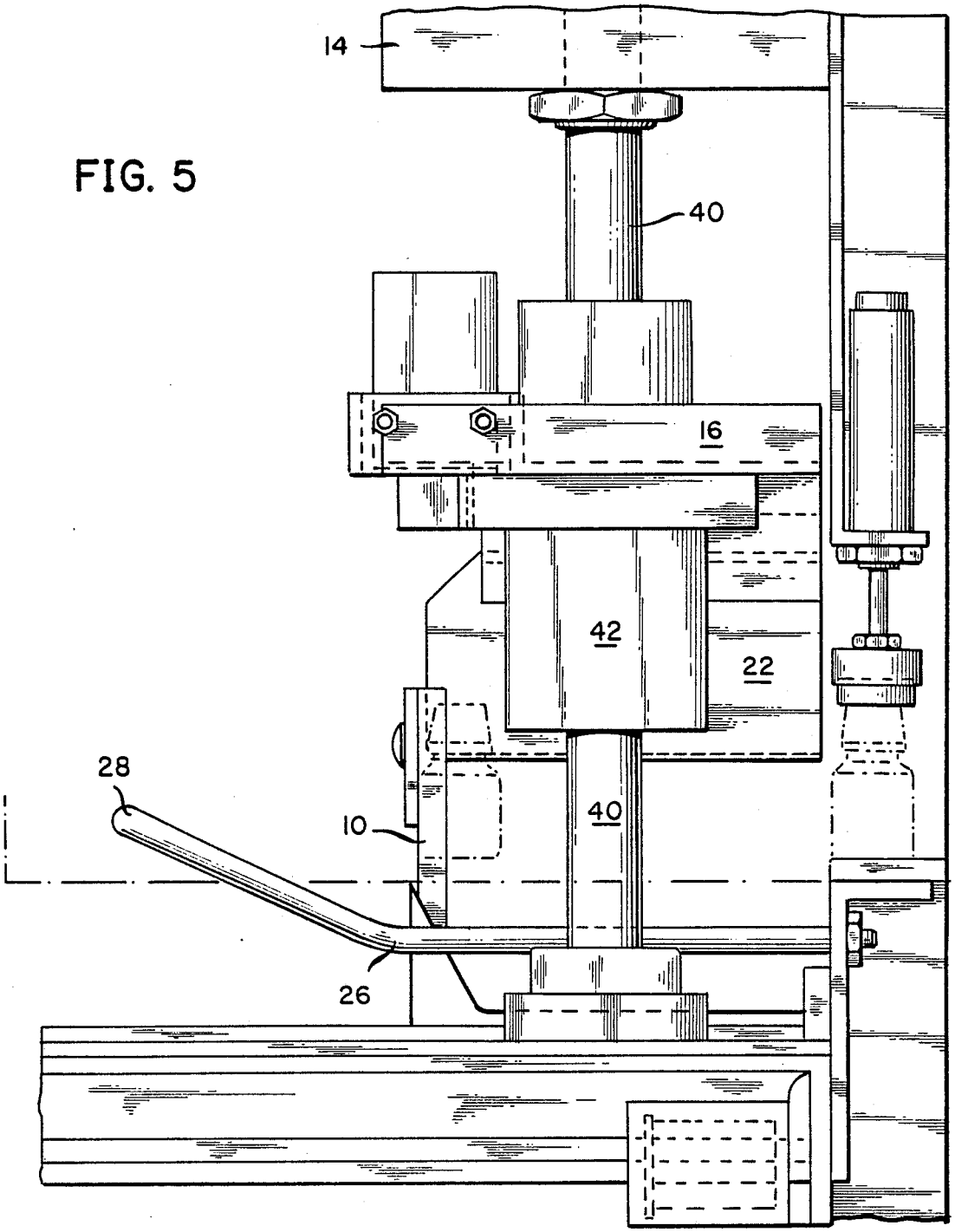
FIG. 5 is a side plan view of the embodiment shown in FIG. 4.

The vial infeed means 34 is preferably oriented at an upwardly inclined angle 46 as best shown in FIG. 3. The vial infeed means 34 also preferably includes a dead plate means 44 for supporting vials 10 moving therethrough. The readily available line pressure of the vials moving through the vial infeed means 34 will create a gentle pressure in order to facilitate urging of the vials 10 through the input ends 28 into the guide channels 26 downstream therefrom. Control of movement of the vials to the positions suspending downwardly from the guide shoulders 32 is facilitated by the orientation of the vial infeed means in the slightly inclined angle. Although this is not specifically required, this inclined angle facilitates orientation of the vials in the longitudinally extending rows within the guide channels 26.

Once the complete array of longitudinal extending rows within guide channels 26 is filled with the carriage means 16 will be moved from the upper position 18 and will move downwardly to a lower position 20. In lower position 20 the individual vials 10 suspending downwardly from the guide shoulders 32 of the guide assembly 22 will be located in an intermediate position 38 with respect to the case 12 therebelow. In this position the vial 10 will extend partially into the case 12 but the bottom of the vial will not contact the bottom receiving surfaces of the case. The case will now be removed and can preferably include a case pusher means 52 to facilitate urging of the case to exit the housing means 14. The case will be oriented to exit the housing means 14 immediately adjacent to the output ends 30 of the guide channels 26. In this manner as the case exits the vials will successively and gently drop into position within the case therebelow. As it exits the edge of the case will contact the upstream laterally extending row of vials and urge the entire array of vials to exit through the output ends 30. In this manner a means for successively packing cases with vials is provided wherein the suspension channels or guide shoulders 32 need not be made movable with respect to the guide assembly 22. The elimination of these multiple moving parts greatly increases reliability and minimizes maintenance of said equipment.

This equipment has been shown to be so reliable as to be particularly usable with multiple guide assemblies 22 secured with respect to a single carriage means 16. It has been found that the most efficient manner is to include three individual guide assemblies 22 all movable between an upper position 18 and a lower position 20 by being secured with respect to a single carriage means 16. The efficiency of operation of such a system is readily apparent due to the volume of packing made possible by such multiple configurations.

The guide assembly preferably includes an inverted T-shaped retainment means for selectively abutting the opposite sides of vials in adjacent rows. In this manner a single T member will abut the opposite sides of vials in immediate adjacent rows. This minimizes the lateral distance required by the configuration of the guide assembly of the present invention and enhances vial retainment as desired. This inverted T-shaped configuration has been shown to be highly effective in high volume and high speed vial packing.

Removal of the case from the position adjacent and immediate below the guide assembly can be achieved by pusher bar means and also is found to be particularly useful being manually removed. Manual removal allows sequential settling of the horizontally extending rows of vials gently into the case positioned immediately therebelow.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for packing vials into a case positioned therebelow comprising:

(a) a housing means adapted to receive vial packing cases therein;

(b) a carriage means movably mounted with respect to said housing means above a case positioned therein, said carriage means being movable between an upper position spatially disposed above the case and a lower position closer to the case therebelow;

(c) a guide assembly secured with respect to said carriage means to be movable therewith, said guide assembly being adapted to receive and retain vials in horizontally extending rows therein, said guide assembly being responsive to downward movement of said carriage means to the lower position to move the vials retained therein to a position extending downwardly partially extending into a case positioned therebelow, said guide assembly comprising:

(1) a plurality of guide members spatially disposed with respect to one another to define guide channels therebetween adapted to receive and removably retain vials therein for arranging thereof into horizontally extending rows, each of said guide channels defining an input end adapted to receive vials there for packing and an output end for exiting of vials, said guide members being movable with said guide assembly and said carriage means to place vials retained horizontally therein in position partially extending into a case positioned therebelow responsive to said carriage means being in the lower position to facilitate removing of vials by urging thereof through said output ends of said guide channels responsive to removal of the case from said housing;

(2) guide shoulder means located on said guide members and extending generally horizontally therefrom to be adapted to abut the vials to facilitate selective retaining thereof within said guide channels;

(d) a vial infeed means positioned adjacent to said input end of said guide channels, said vial infeed means adapted to provide vials for supplying thereof into said guide channels by urging same through said input ends thereof; and (e) a drive means operatively secured with respect to said carriage means for urging movement thereof between an upper position and a lower position, said carriage means being responsive to being in the upper position to facilitate said guide assembly to receive vials through said input ends of said guide channels from said vial infeed means, said carriage means being responsive to being in the lower position to position the vials extending downwardly partially into the case therebelow to facilitate removal of vials positioned within said guide channels through said output means thereof responsive to removal of the case from said housing.

2. An apparatus for packing vials into a case positioned therebelow as defined in claim 1 wherein said guide members of said guide assembly define five longitudinally extending guide channels.

3. An apparatus for packing vials into a case positioned therebelow as defined in claim 1 wherein said carriage means is movable vertically.

4. An apparatus for packing vials into a case positioned therebelow as defined in claim 3 wherein said housing includes vertical rods and wherein said carriage means includes vertical coupling means adapted to engage said rods to facilitate guiding of vertical movement of said carriage means with respect to said housing.

5. An apparatus for packing vials into a case positioned therebelow as defined in claim 1 wherein said vial infeed means includes a dead plate means positioned below vials located within said vial infeed means to facilitate support thereof.

6. An apparatus for packing vials into a case positioned therebelow as defined in claim 1 wherein said vial infeed means is inclined upwardly toward said guide assembly immediately adjacent said input ends of said guide channels to facilitate movement of vials therein.

7. An apparatus for packing vials into a case positioned therebelow as defined in claim 1 wherein said guide members comprises vertically extending guide plates positioned adjacent said guide channels.

8. An apparatus for packing vials into a case positioned therebelow as defined in claim 7 wherein said guide shoulder means are fixedly secured with respect to said guide members and extend horizontally outwardly therefrom to engage the vials in the neck area to facilitate removal retaining thereof.

9. An apparatus for packing vials into a case positioned therebelow as defined in claim 1 wherein said guide shoulder means are secured to the lowermost end of said guide members and extend horizontally outwardly therefrom.

10. An apparatus for packing vials into a case positioned therebelow as defined in claim 1 wherein said carriage means is responsive to being in the lower position to locate the vials in an intermediate position partially extending into the case with the bottom of the case located spatially disposed below the bottom of the vials.

11. An apparatus for packing vials into a case positioned therebelow as defined in claim 1 wherein said guide members are fixedly secured with respect to said guide assembly.

12. An apparatus for packing vials into a case positioned therebelow as defined in claim 1 wherein said guide shoulders are fixedly secured with respect to said guide members.

13. An apparatus for packing vials into a case positioned therebelow as defined in claim 1 further comprising a case pusher means adapted to abut a case positioned within said housing for urging same to exit said housing.

14. An apparatus for packing vials into a case positioned therebelow as defined in claim 13 wherein all vials located within said guide channels are located at the intermediate position within the case therebelow and are removed from the guide assembly responsive to actuation of said case pusher means.

15. An apparatus for packing vials into a case positioned therebelow as defined in claim 13 wherein said case pusher means is adapted to urge the case to exit said housing adjacent said output end of said channel guide means to facilitate removal of vials therewith from said channel guide means located in the intermediate position partially within the case therebelow.

16. An apparatus for packing vials into a case positioned therebelow comprising:

(a) a housing means adapted to receive vial packing cases therein, said housing including vertically extending rods therein;

(b) a carriage means mounted vertically movable with respect to said housing means above a case positioned therein, said carriage means being vertically movable between an upper position spatially disposed above the case and a lower position closer to the case therebelow, said carriage means further including vertical coupling means adapted to engage said vertically extending rods to facilitate guiding of vertical movement of said carriage means with respect to said housing;

(c) a guide assembly secured with respect to said carriage means to be movable therewith, said guide assembly being adapted to receive and retain vials in horizontally extending rows therein, said guide assembly being responsive to downward movement of said carriage means to the lower position to move the vials retained therein to a position extending downwardly partially extending into a case positioned therebelow, said guide assembly comprising:

(1) a plurality of guide members comprising vertically extending guide plates spatially disposed with respect to one another to define at least five guide channels therebetween adapted to receive and removably retain vials therein for arranging thereof into horizontally extending rows, each of said guide channels defining an input end adapted to receive vials therein for packing and an output end for exiting of vials, said guide members being movable with said guide assembly and said carriage means to place vials retained horizontally therein in position partially extending into a case positioned therebelow responsive to said carriage means being in the lower position to facilitate removing of vials by urging thereof through said output ends of said guide channels responsive to removal of the case from said housing;

(2) guide shoulder means fixedly secured to the lowermost end of said guide plates and extending generally horizontally outward therefrom to be adapted to abut the neck areas of the vials to facilitate selective retaining thereof within said guide channels;

(d) a vial infeed means positioned adjacent to said input end of said guide channels, said vial infeed means adapted to provide vials for supplying thereof into said guide channels by urging same through said input ends thereof, said vial infeed means including a dead plate means positioned below vials located therein to facilitate support thereof prior to movement into said guide channels, said vial infeed means being inclined upwardly toward said guide assembly immediately adjacent said input ends of said guide channels to facilitate movement of vials therein;

(e) a drive means operatively secured with respect to said carriage means for urging movement thereof between an upper position and a lower position, said carriage means being responsive to being in the upper portion to facilitate said guide assembly to receive vials through said input ends of said guide channels from said vial infeed means, said carriage means being responsive to being in the lower position to position the vials extending downwardly partially into the case therebelow to facilitate removal of vials positioned within said guide channels through said output ends thereof responsive to removal of the case from said housing; and (f) a case pusher means adapted to abut the case positioned within said housing and urge same to exit said housing adjacent said output ends of said guide channels simultaneously with said carriage means being in the lower position and the vials being in the intermediate position to facilitate removal thereof through said output ends thereof.

17. A method for packing vials into a case positioned therebelow comprising:

(a) supplying a plurality of vials through an infeed station to a vial packing station;

(b) urging the vials through an inlet end of the vial packing station;

(c) orienting the vials into a horizontally extending array of rows to facilitate packing into the case therebelow;

(d) suspending the horizontally extending rows of vials above the case positioned therebelow;

(e) moving the array of vials downwardly to an intermediate position extending partially into the case therebelow with the vials immediately adjacent the case;

(f) removing the case from the vial packing station by horizontal movement thereof while in abutment with respect to the vials partially extending therein;

(g) removing the rows of vials through an outlet end of the vial packing station by abutment of the case with respect to the vials extending partially into the case simultaneously with removing of the case from the vial packing station; and (h) allowing the removed vials to complete the downward movement into the case therebelow after exiting the outlet end of the vial packing station.

18. A method for packing vials into a case positioned therebelow as defined in claim 17 wherein said supplying of a plurality of vials is performed along an upwardly inclined plane extending to a position adjacent the inlet end of the vial packing station.

19. A method for packing vials into a case positioned therebelow as defined in claim 17 wherein said suspending of the rows of vials above the case includes retaining of the vials in the neck area thereof to facilitate freedom of movement thereof during suspension.

20. A method for packing vials into a case positioned therebelow as defined in claim 17 wherein said horizontal removing of the case from the vial packing station further comprises pushing the case out of the vial packing station adjacent the outlet end thereof.

21. A method for packing vials into a case positioned therebelow as defined in claim 17 wherein after moving the array of vials downwardly to an intermediate position the removing of the case from the vial packing station by horizontal movement thereof and the removing of rows of vials through an outlet end of the vial packing station is performed while maintaining the vial packing station stationary.

22. A method for packing vials into a case positioned therebelow as defined in claim 17 wherein the vials are oriented into an array of rows to facilitate packing into the case therebelow by an inverted T-shaped holding means adapted to hold the opposite sides of vials in adjacent rows selectively therein.

23. The method for packing vials into a case positioned therebelow as defined in claim 17 wherein the removing of the case from the vial packing station by horizontal movement thereof is manually powered.

24. A method for packing vials into a case positioned therebelow comprising:

(a) supplying a plurality of vials to a vial packing station through an infeed station along an upwardly inclined plane extending to a position adjacent the inlet end of the vial packing station;

(b) urging the vials through an inlet end of the vial packing station;

(c) orienting the vials into a horizontally extending array of rows to facilitate packing into the case therebelow;

(d) suspending horizontally extending the rows of vials above the case positioned therebelow by retaining of the vials in the neck area thereof to facilitate freedom of movement thereof during suspension;

(e) moving of array of vials downwardly to an intermediate position extending partially into the case therebelow with the vials immediately adjacent the case;

(f) removing the case from the vial packing station by horizontally pushing the case out of the vial packing station adjacent the outlet end thereof while in abutment with respect to the vials partially extending therein;

(g) removing the rows of vials through an outlet end of the vial packing station by abutment of the case with respect to the vials extending partially into the case simultaneously with removing of the case from the vial packing station; and (h) allowing the removed vials to complete the downward movement into the case therebelow after exiting the outlet end of the vial packing station.

* * * * *